US008453896B1

(12) United States Patent
Mansell

(10) Patent No.: US 8,453,896 B1
(45) Date of Patent: Jun. 4, 2013

(54) WATERPROOF BACKPACK WITH INTEGRAL GARMENT HANGERS

(76) Inventor: Jonathan Mansell, Brandon, MS (US)

( * ) Notice: Subject to any disclaimer, the term of this patent is extended or adjusted under 35 U.S.C. 154(b) by 831 days.

(21) Appl. No.: 12/229,386

(22) Filed: Aug. 22, 2008

(51) Int. Cl.
*B65D 85/18* (2006.01)
*A41D 27/22* (2006.01)

(52) U.S. Cl.
USPC ..... 224/576; 206/287; 206/287.1; 223/89; 223/94

(58) Field of Classification Search
USPC . 224/575, 576, 652; 223/89, 90, 94; 206/289, 206/290, 291, 287, 287.1
See application file for complete search history.

(56) References Cited

U.S. PATENT DOCUMENTS

| | | | | | |
|---|---|---|---|---|---|
| 713,376 | A | | 11/1902 | Baer | |
| 952,202 | A | * | 3/1910 | Klingenfeld | 223/89 |
| 2,209,171 | A | * | 7/1940 | Plotkin | 206/292 |
| 2,425,527 | A | * | 8/1947 | Gaudino | 223/94 |
| 2,754,038 | A | | 7/1956 | Varker | |
| 4,085,873 | A | | 4/1978 | Schweitzer | |
| 4,186,857 | A | | 2/1980 | Helms, Jr. | |
| 4,655,343 | A | * | 4/1987 | Lane et al. | 206/287.1 |
| 4,662,513 | A | * | 5/1987 | King et al. | 206/287.1 |
| D290,190 | S | | 6/1987 | Stolarz | |
| 4,669,642 | A | * | 6/1987 | Nicholas | 223/94 |
| 4,730,757 | A | | 3/1988 | Keller | |
| 4,869,408 | A | * | 9/1989 | Lutz | 224/417 |
| 4,901,897 | A | * | 2/1990 | Briggs et al. | 224/153 |
| 4,927,014 | A | * | 5/1990 | Pulichino, Jr. | 206/287.1 |
| 4,932,571 | A | * | 6/1990 | Blanchard | 223/89 |
| 4,948,019 | A | | 8/1990 | Rodum | |
| 4,974,709 | A | * | 12/1990 | Furlow et al. | 190/102 |
| 5,474,162 | A | * | 12/1995 | Shyr et al. | 190/18 A |
| 5,566,797 | A | * | 10/1996 | Van Himbeeck | 190/18 A |
| D375,402 | S | | 11/1996 | Yeh | |
| 5,590,823 | A | | 1/1997 | Lunde | |
| 5,622,255 | A | | 4/1997 | Riccoboni | |
| 5,632,422 | A | * | 5/1997 | Csengeri | 223/89 |
| 5,706,992 | A | * | 1/1998 | Moor | 224/657 |
| 5,732,817 | A | * | 3/1998 | Plath | 206/298 |
| 5,785,219 | A | | 7/1998 | Kraft | |
| D428,712 | S | | 8/2000 | Wooler | |
| 6,189,750 | B1 | * | 2/2001 | Von Neumann | 224/153 |
| 6,487,760 | B1 | * | 12/2002 | Larsen | 24/598.7 |
| 6,540,121 | B1 | | 4/2003 | Harvey | |
| D552,845 | S | | 10/2007 | Shor et al. | |
| 7,784,654 | B1 | * | 8/2010 | Mercado | 223/89 |
| 2012/0006638 | A1 | * | 1/2012 | Semersky | 190/115 |

* cited by examiner

*Primary Examiner* — Nathan J Newhouse
*Assistant Examiner* — Todd Anderson
(74) *Attorney, Agent, or Firm* — Montgomery Patent & Design; Robert C. Montgomery

(57) ABSTRACT

A backpack with integral garment hanging means is herein disclosed, comprising a large rear compartment that can neatly store clothes by means of folding hangers. To access the rear compartment, one would disconnect a pair of shoulder straps and open a zipper along both sides and upper surfaces of the backpack, thereby leaving the front cover hinged at the base. When disconnected it exposes a rounded "headstone"-shaped rear compartment having a plurality of folding garment hangers attached at the top. The hangers have a short neck and are hinged at their outward points to accommodate the small confines of the compartment. This backpack allows for the placement of several articles of clothing on folding hangers inside the backpack minimizing wrinkling. The hangers can be removed and used on a conventional closet rod. The exterior covering of the backpack is of a waterproof textile material to allow use in the rain as well.

20 Claims, 6 Drawing Sheets

WATERPROOF BACKPACK WITH INTEGRAL GARMENT HANGERS

RELATED APPLICATIONS

The present invention was first described in a notarized Official Record of Invention on Oct. 9, 2007, that is on file at the offices of Montgomery Patent and Design, LLC, the entire disclosures of which are incorporated herein by reference.

FIELD OF THE INVENTION

The present invention relates generally to a waterproof backpack with integral garment hangers and, more particularly, to said backpack comprising a large rear compartment and cover assembly, wherein said rear compartment allows for the hanging of several articles of clothing thereon a plurality of folding garment hangers.

BACKGROUND OF THE INVENTION

At one time, the common backpack was only used for camping trips to carry gear, food and supplies into the wilderness. However, as its popularity grew, it became commonly seen carrying books, papers and homework back and forth to school. Recently, it has entered into the business world as well as a functional and safe way to carry portable computers, along with other electronic business aids and important papers. It has gained this increased popularity due mainly to the fact that it facilitates the carrying of relatively heavy loads with ease since the shoulder straps and perhaps even a waist strap helps to distribute the weight over the entire body. This is in sharp contrast to the concentrated loads placed on arms and shoulders by conventional handles and straps. However, one area in which the use of the backpack has not seen service is that of luggage. This is primarily due to the fact that it is difficult to store clothing inside where it will not become exceedingly wrinkled. Accordingly, there exists a need for a means by which the convenience and functionality of a backpack design can be emulated in a line of luggage. The development of the invention herein described fulfills this need.

The present invention is a waterproof backpack with integral garment hangers. The backpack comprises shoulder straps, multiple compartments, various zippers, flaps and the like and there is a large rear compartment that is accessed from under the straps. A zipper is provided which opens along the sides and upper surfaces of the backpack, with this rear flap hinged at the bottom. This exposes a rounded, "headstone"-shaped compartment with a series of clothes hangers attached at the top through an integral loop. The hangers have a short neck and are hinged at their outward point to accommodate the small confines of the compartment. This compartment allows the user to place a change of clothes for several days inside and on the hangers where wrinkling and creasing will be minimal. The hangers can be used at hotels as well where they can simply be transferred back and forth. Finally, the outer covering of the backpack is of a waterproof nature to allow use in the rain as well. The use of the present invention provides a handy means to stow and transport clothing and other supplies on quick trips with the convenience and functionality of a backpack.

Several attempts have been made in the past to provide a portable combination backpack and garment bag and collapsible garment hangers. U.S. Pat. No. 4,085,873, issued in the name of Schweitzer, describes a knapsack with integral storage and carrying pouch comprising a receptacle of material including a patch through which a pouch may be pushed through which may be used as a storage and carrying enclosure, specifically configured for racquets and balls. However, unlike the present invention, the Schweitzer knapsack is simply an expandable storage pouch lacking a plurality of storage compartments and the means for containing an integral garment hanger.

U.S. Pat. No. 5,622,255, issued in the name of Riccoboni, discloses a portfolio-style garment bag. The Riccoboni garment bag comprises a book-like garment bag for storing and organizing folded suits or dresses with a build in hanger system on a spiral binding. However, unlike the present invention, the Riccoboni garment bag is simply a modified traditional folding garment bag, lacking the multiple storage means for various types of articles.

U.S. Pat. No. 5,785,219, issued in the name of Kraft, discloses a combination knapsack comprising a traditional knapsack with an integral flap which may be extended for use as a blanket while a person is sitting or laying while using the knapsack as a headrest. However, unlike the present invention, the Kraft knapsack is simply a traditional storage enclosure which also doubles as bedding materials and lacks the multiple storage means for various types of articles and integral hanger.

U.S. Pat. No. 4,186,857, issued in the name of Helms, Jr., discloses a collapsible coat hanger comprising a first and second arm which pivot on a pin and a hook which rotates thereby collapsing the hanger into a storage configuration. However, unlike the present invention, the Helms hanger has no utility while in a collapsed configuration.

U.S. Pat. No. 4,730,757, issued to Keller and U.S. Pat. No. 4,948,019 issued in the name of Rodum, disclose a collapsible clothes hanger. Both the Keller and the Rodum hangers comprise a first and a second arm which are collapsible to one another placing the hanger in a stored configuration. However, unlike the present invention, the Keller and Rodum hangers also have no utility while in a fully collapsed configuration and are merely space-saving, foldable traditional hangers.

Additionally, various ornamental designs for backpacks have been provided, particularly, U.S. Pat. Nos. D 375,402 and D 552,845. However, none of these designs are similar to the present invention.

Additionally, various ornamental designs for collapsible garment hangers have been provided, particularly, U.S. Pat. Nos. D 428,712 and D 290,190. However, none of these designs are similar to the present invention.

The prior art appears to disclose various types of garment bags and backpacks and collapsible hangers. However, none of the prior art particularly describes a waterproof combination backpack and garment bag with integral garment hangers with folding outer ends. Accordingly, there exists a need for a waterproof backpack with integral garment hangers without the disadvantages as described above.

SUMMARY OF THE INVENTION

In view of the foregoing disadvantages inherent in the prior art, it has been observed that there is need for a waterproof backpack with integral garment hangers.

To achieve the above objects, it is an object of the present invention to provide a backpack comprising a large rear compartment assembly, a cover assembly, and at least one (1) folding garment hanger.

It is an object of the present invention to have the rear compartment assembly comprise a rear panel, a first loop, at least one (1) first pocket, a second pocket, at least one (1) rear compartment restraining strap, at least one (1) external fifth pocket, a sixth pocket, and a second loop, where the rear panel forms a suitcase-like cavity which provides the main enclosure for hung and stowed articles of clothing.

A further object of the present invention is to have the rear compartment restraining strap which laterally extends across the rear panel to provide a means to secure a plurality of clothing articles and comprise a sewn-in strap latch for tightening adjustments.

Yet still another object of the present invention is to have a first pocket located along the interior surface of the rear panel which provides an additional means of personal article storage.

Yet still another object of the present invention is to have a second pocket located along the interior surface of the rear panel comprising a mesh pocket which provides an additional means of personal article storage and is opened and closed by a second zipper and second zipper puller.

Yet still another object of the present invention is to have a fifth pocket located along an exterior side surface of the rear compartment assembly which provides additional means of personal article storage and comprises a fifth pocket flap which provides a means to close and secure the fifth pocket.

Yet still another object of the present invention is to have a sixth pocket located along an exterior side surface of the rear compartment assembly which provides additional means of personal article storage and is opened and closed by a third zipper and third zipper puller.

Yet still another object of the present invention is to have a first loop which is connected to the top exterior of the rear compartment assembly which provides a means of hanging the backpack when not being carried.

Yet still another object of the present invention is to have a second loop located on the internal upper central surface of the rear compartment assembly which provides a means of removably affixing the folding garment hanger inside the rear compartment assembly.

Yet still another object of the present invention is to have a cover assembly comprise a front panel, a third pocket, at least one (1) cover restraining strap, and a first and second shoulder strap which mates with and attaches to the outline of the rear compartment assembly by a first zipper.

Yet still another object of the present invention is to have a first zipper which extends around the side and perimeter edges of the rear compartment assembly and the cover assembly and further comprising a first zipper puller which allows a user a means to access the rear compartment assembly by moving the first zipper puller to an opposing lower end of the mated cover assembly and rear compartment assembly.

Yet still another object of the present invention is to have a cover restraining strap which laterally extends across the front panel which provides a means to secure a plurality of clothing articles and comprise a sewn-in strap latch for tightening adjustments.

Yet still another object of the present invention is to have a third pocket located along the inner surface of the front panel comprising a mesh open pocket which provides an additional means of personal article storage.

Yet still another object of the present invention is to have a first shoulder strap which attaches to the exterior upper edge of the cover assembly and comprise a first adjustable strap on a lower end which extends downward and adjustably attaches to a first lower strap which is sewn into the exterior lower edge of the cover assembly by a first buckle, thereby providing a means of carrying the backpack over-the-shoulder and on the back of a user.

Yet still another object of the present invention is to have a second shoulder strap which attaches to the exterior upper edge of the cover assembly and comprise a second adjustable strap on a lower end which extends downward and adjustably attaches to a second lower strap, which is sewn into the exterior lower edge of the cover assembly by a second buckle, thereby providing a means of carrying the backpack over-the-shoulder and on the back of a user.

Yet still another object of the present invention is to have a folding garment hanger comprise an upper rod, a hook, a first and second folding section, and a lower rod, thereby providing a means of hanging and transporting clothing articles inside the rear compartment assembly, thereby minimizing wrinkling.

Yet another object of the present invention is to have a hook comprise a semi-circular hook which provides a means of hanging the folding garment hanger.

Yet still another object of the present invention is to have an upper rod which forms the "Y"-shape of the folding garment hanger body.

Yet still another object of the present invention is to have a hanger neck which provides a transition between the hook and the upper rod.

Yet still another object of the present invention is to have a first folding section which attaches to a first end of the upper rod by an upper hinge and to a first end of the lower rod by a lower hinge.

Yet still another object of the present invention is to have a second folding section which attached to a second opposing end of the upper rod by an upper hinge and to a second opposing end of the lower rod by a lower hinge.

Yet still another object of the present invention is to have a first and a second folding section which rotate inward and provides a means of reducing the width of the folding garment hanger thereby allowing the hanger to fit inside the rear compartment assembly.

Yet still another object of the present invention is to have a reinforced area comprise a resilient sewn-in panel which covers the bottom and lower sides and end of the backpack.

Yet still another object of the present invention is to have a waist strap located on the lower side ends of the front panel and comprise a side release latching mechanism which provides an additional means of securing the backpack to the waist of a wearer.

Yet still another object of the present invention is to have a rear pouch located along the exterior surface of the rear compartment assembly and comprise an adjustable rear pouch opening, a draw string and cinch lock mechanism which provides an additional means of personal article storage.

Yet still another object of the present invention is to have a rear pouch flap which folds over the rear pouch and is secured by a third buckle located on the exterior surface of the rear pouch which provides a means of protection to the rear pouch.

Yet still another object of the present invention is to have a rear pocket located along an exterior surface of the rear pouch and comprise an upper flap and forth latch for protecting and securing the rear pocket which provides an additional means of personal article storage.

Yet still another object of the present invention is providing a method for utilizing a waterproof backpack with integral garment hangers.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
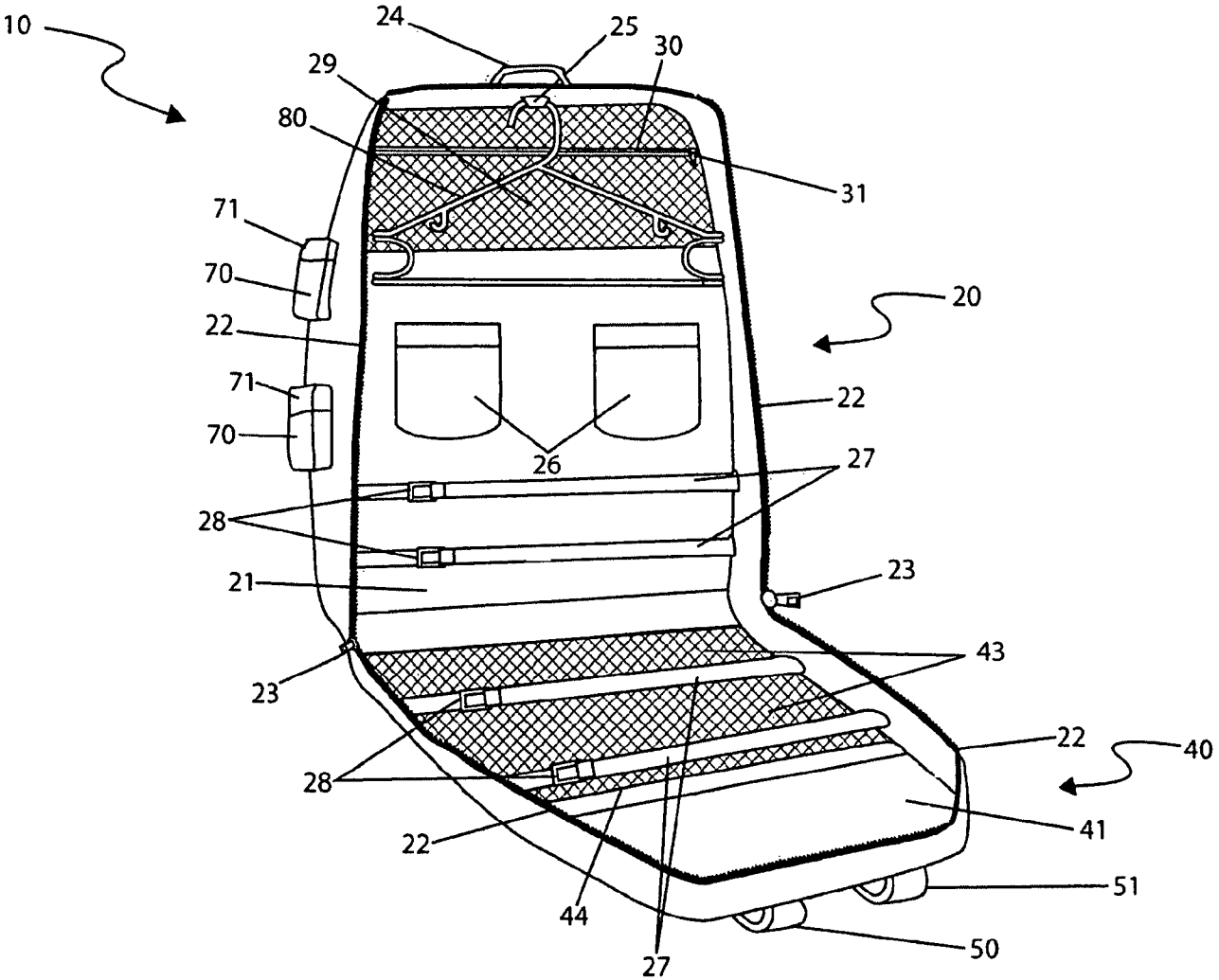
FIG. 1 is a front perspective view of a waterproof backpack with integral garment hangers 10 depicting an open state, according to a preferred embodiment of the present invention.

| | |
|---|---|
| 10 | waterproof backpack with integral garment hangers |
| 20 | rear compartment assembly |
| 21 | rear panel |
| 22 | first zipper |
| 23 | first zipper puller |
| 24 | first loop |
| 25 | second loop |
| 26 | first pocket |
| 27 | restraining strap |
| 28 | strap latch |
| 29 | second pocket |
| 30 | second zipper |
| 31 | second zipper puller |
| 40 | forward cover assembly |
| 41 | front panel |
| 43 | third pocket |
| 44 | third pocket opening |
| 45 | reinforced area |
| 50 | first shoulder strap |
| 51 | second shoulder strap |
| 52 | first adjustable strap |
| 53 | second adjustable strap |
| 54 | first buckle |
| 55 | second buckle |
| 58 | first lower strap |
| 59 | second lower strap |
| 60 | fourth pocket |
| 61 | fourth pocket flap |
| 65 | waist strap |
| 70 | fifth pocket |
| 71 | fifth pocket flap |
| 80 | folding garment hanger |
| 81 | upper rod |
| 82 | hanger hook |
| 83 | lower rod |
| 84 | hanger neck |
| 85 | folding hanger section |
| 86 | garment hook |
| 90 | upper hinge |
| 91 | lower hinge |
| 100 | sixth pocket |
| 101 | third zipper |
| 102 | third zipper puller |
| 110 | rear pouch |
| 111 | rear pouch flap |
| 112 | third buckle |
| 114 | rear pouch opening |
| 115 | cinch lock mechanism |
| 116 | draw string |

-continued

| | |
|---|---|
| 120 | rear pocket |
| 121 | fourth buckle |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for a waterproof backpack with integral garment hangers (herein described as the "apparatus") 10, comprising a backpack with an integral garment hanging means. The apparatus 10 comprises a large rear compartment 20 shaped like a "headstone" that can neatly store clothes by means of folding garment hangers 80. To access the rear compartment 20, one would disconnect a pair of shoulder straps and open a first zipper 22 along both sides and upper surfaces of the apparatus 10 allowing a forward cover 40 to hinge outwardly. The folding garment hangers 80 have a short neck 86 and integral hinges 90 at their outward extremities to accommodate the small confines of the apparatus 10. The apparatus 10 allows placement of several articles of clothing on folding hangers 80, thereby minimizing wrinkling. The exterior covering of the apparatus 10 is of a waterproof textile material to allow use in the rain as well. It is envisioned that the waterproof textile material of the apparatus 10 will be constructed out of a Gore-Tex material or other similar waterproof material.

Referring now to FIG. 1, a front perspective view of the apparatus 10 depicting an open state, according to a preferred embodiment of the present invention, is disclosed. The apparatus 10 comprises a textile enclosure being similar in shape to common backpacks having a general profile of a headstone. The apparatus 10 comprises a rear compartment assembly 20, a joining first zipper 22, and a forward cover assembly 40.

The rear compartment assembly 20 comprises a textile assembly made using rugged water-proof fabrics such as canvas, coated cotton cloth, various synthetic materials, or the like forming a large rear panel 21 having side portions which extend forward in an expected manner forming a suitcase-like cavity. The first zipper 22 extends therearound side and top perimeter edges of the rear compartment assembly 20 providing an attachment means thereto the forward cover assembly 40. The first zipper 22 comprises a heavy-duty plastic or metal device further comprising two (2) zipper pullers 23 allowing a user convenient exposure of the rear compartment 20 and forward cover 40 by moving said zipper pullers 23 thereto opposing lower portions of the rear compartment assembly 20 allowing the forward cover assembly 40 to hinge about a lower seam in an expected manner. The rear compartment assembly 20 further comprises a waterproof textile construction providing expected popular backpack features including a first zipper 22, a first loop 24 providing a hanging means thereto the apparatus 10, a pair of internal first pockets 26, a pair of internal elastic restraining straps 27, a large elastic see-through mesh second pocket 29, a first shoulder strap 50, a second shoulder strap 51, and a pair of external fifth pockets 70. The restraining straps 27 comprise a pair of laterally extending elastic restraining straps 27 providing a securing means thereto hanging garments, holding said garments against the rear panel 21. The restraining straps 27 comprise sewn-in strap latch 28 such as, but not limited to: interlocking male/female tabs, buckles, snaps, hooks, hook-and-loop strapping, or the like. The second pocket 29 is located along an inner surface being approximately fourteen (14) inches wide by approximately six (6) inches high being secured using a second zipper 30 operated by a second zipper puller 31. The first pockets 26 comprise rectangular fabric enclosures and are located along an interior surface of the rear panel 21 providing convenient storage of items such as, for example: stain remover fluid, a sewing kit, misting bottle for wrinkle removal, and the like. The fifth pockets 70 comprise rectangular enclosures further comprising fifth pocket flaps 71 envisioned to provide common fastening means such as hook-and-loop or snapping fasteners. The apparatus 10 is illustrated here showing a pair of fifth pockets 70; however, any number of fifth pockets 70 may be arranged along outer side surfaces of the rear compartment assembly 20. The fifth pockets 70 may provide various internal dimensions suitable for carrying various personal items such as, but not limited to: a cell phone, a pager, toiletries, and the like. The first pockets 26 and fifth pockets 70 are envisioned being made using similar fabric materials as the rear compartment assembly 20 and further comprising expected features such as upper opening fifth pocket flaps 71 having hook-and-loop or snapping fasteners.

Figure 4:
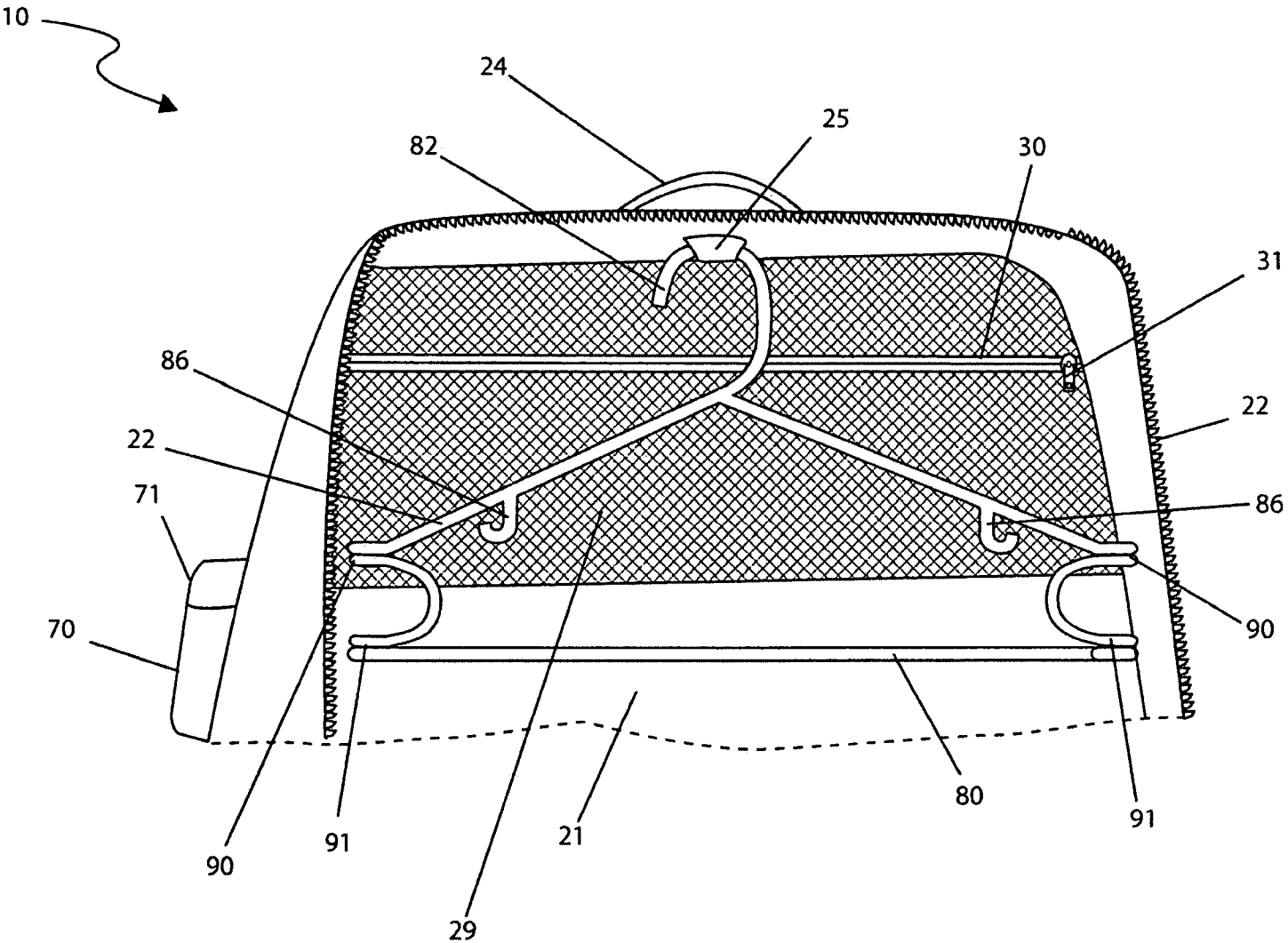
FIG. 4 is a close-up view of an inner space of a waterproof backpack with integral garment hangers 10, according to a preferred embodiment of the present invention; and, FIG. 5 is a front view of a folding garment hanger 80, according to a preferred embodiment of the present invention.

In addition thereto the aforementioned conventional features, the rear compartment assembly 20 comprises particular enhancements enabling hanging of garments therein via a second loop 25 and a plurality of folding garment hangers 80 (see FIG. 4). The rear compartment assembly 20 provides an attachment means thereto the forward cover assembly 40 via a sewn seam along a bottom horizontal edge region.

The forward cover assembly 40 comprises a mating outline and attachment thereto the aforementioned rear compartment assembly 20 via the first zipper 22. The forward cover assembly 40 further comprises a front panel 41, a third pocket 43, and an additional pair of restraining straps 27 and strap latches 28. The front panel 41 comprises a padded textile assembly made using similar waterproof materials and construction as the rear panel portion 21 of the rear compartment assembly 20 having side and top portions being slightly upturned so as to facilitate the first zipper portion 22 being sewn thereto along said outer perimeter edge. The third pocket 43 is envisioned to provide a large rectangular storage space made using a similar construction and elastic see-through mesh material as the aforementioned second pocket 29. The third pocket 43 further comprises a large third pocket opening 44 extending laterally therefrom opposing outer edges of the forward cover assembly 40 being adjacent thereto a top edge thereof allowing storage of additional large clothing and/or personal items. The rear compartment assembly 20 and forward cover assembly portions of the apparatus 10 are envisioned to be introduced in a variety of colors and patterns based upon a user's preferences. The shoulder straps 50, 51 comprise thick foam padded members approximately three (3) inches wide providing protection thereto a user's shoulder areas being affixed thereto an upper edge region of the rear compartment assembly 20 using conventional sewing techniques. The shoulder straps 50, 51 extend therefrom in a downward direction providing a sewn attachment thereto a first adjustable strap 52 and a second adjustable strap 53, respectively, and are envisioned being made using common nylon strapping material approximately one (1) inch wide. The adjustable straps 52, 53 further comprises respective first 54 and second 55 buckles envisioned to be preferably, but not exclusively, standard slip-lock buckles with integral ladder-type apertures providing a length adjustment means thereto the adjustable straps 52, 53. Said buckles 54, 55 provide a looped and sewn attachment means thereto a first lower strap 58 and second lower strap 59 which are in turn sewn thereto a lower portion of the rear compartment assembly 20 in a conventional manner.

Figure 2:
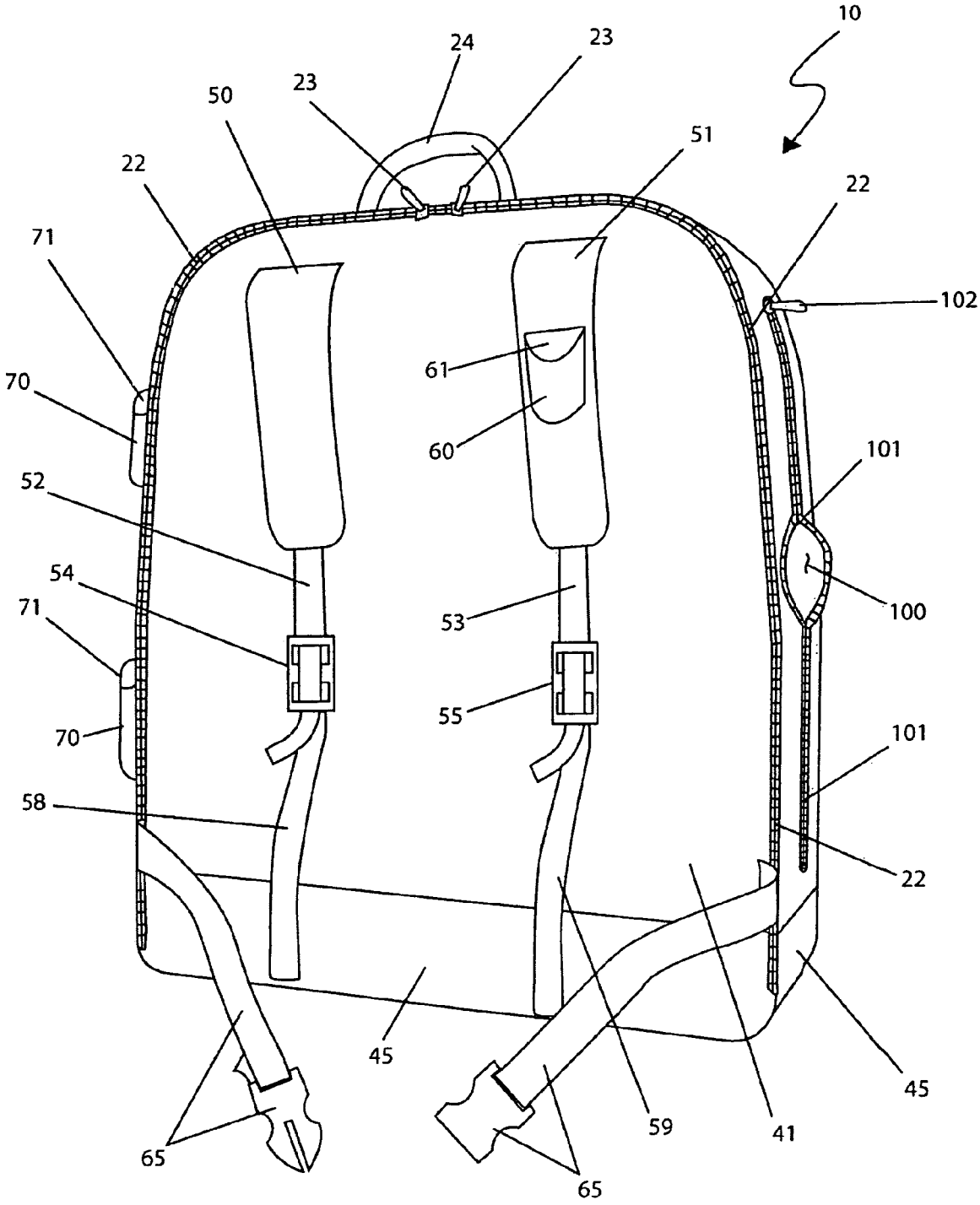
FIG. 2 is a front perspective view of a waterproof backpack with integral garment hangers 10 depicting a closed state, according to a preferred embodiment of the present invention.

Referring now to FIG. 2, a front perspective view of the apparatus 10 depicting a closed state, according to a preferred embodiment of the present invention 10, is disclosed. The apparatus 10 comprises a reinforced area 45, and a sixth pocket 100. The apparatus 10 is illustrated here with the first zipper 22 completely closed having both first zipper pullers 23 at an upper position being adjacent thereto one another and providing closure thereto the rear compartment assembly 20 and forward cover assembly 40 in an expected manner. The reinforced area 45 comprises a rugged sewn-in panel made using preferably leather covering bottom and lower side areas of the apparatus 10. The reinforced area 45 provides additional protection thereto the apparatus 10 against abrasion and puncture being similar to other popular backpack designs. The sixth pocket 100 provides a user a large internal storage pocket along a single side surface of the rear compartment 20 being approximately sixteen (16) inches deep and sixteen (16) inches high. The sixth pocket 100 further comprises a third zipper 101 extending vertically along said side surface sufficient in length so as to allow insertion of large objects such as, but not limited to: laptop computers, folded shirts, documents, and the like and operated by a third zipper puller 102. The front panel 41 provides an attachment means thereto a waist strap 65 which provides a means to redistribute a portion of the weight of the apparatus 10 to a user's hip area in a similar fashion as found on many popular backpack designs being common in the industry. The waist strap 65 comprises rugged strapping and common side-release latching components similar to the previously described shoulder straps 50, 51 and the third buckle portion 112 of the rear flap 111. The waist strap 65 is envisioned being detachable therefrom said front panel 41 via common fasteners or may be sewn thereto said front panel 41 using common textile techniques. A fourth pocket 60 comprises a rectangular internal area being particularly suitable to personal electronic devices such as, but not limited to: cell phones, blackberries, personal digital assistants (PDA), and the like. The fourth pocket 60 and a fourth pocket flap 61 are envisioned being made using similar materials as the aforementioned rear compartment assembly 20 and being affixed thereto one another using common fasteners such as hook-and-loop regions, snapping fixtures, or the like.

Figure 3A:
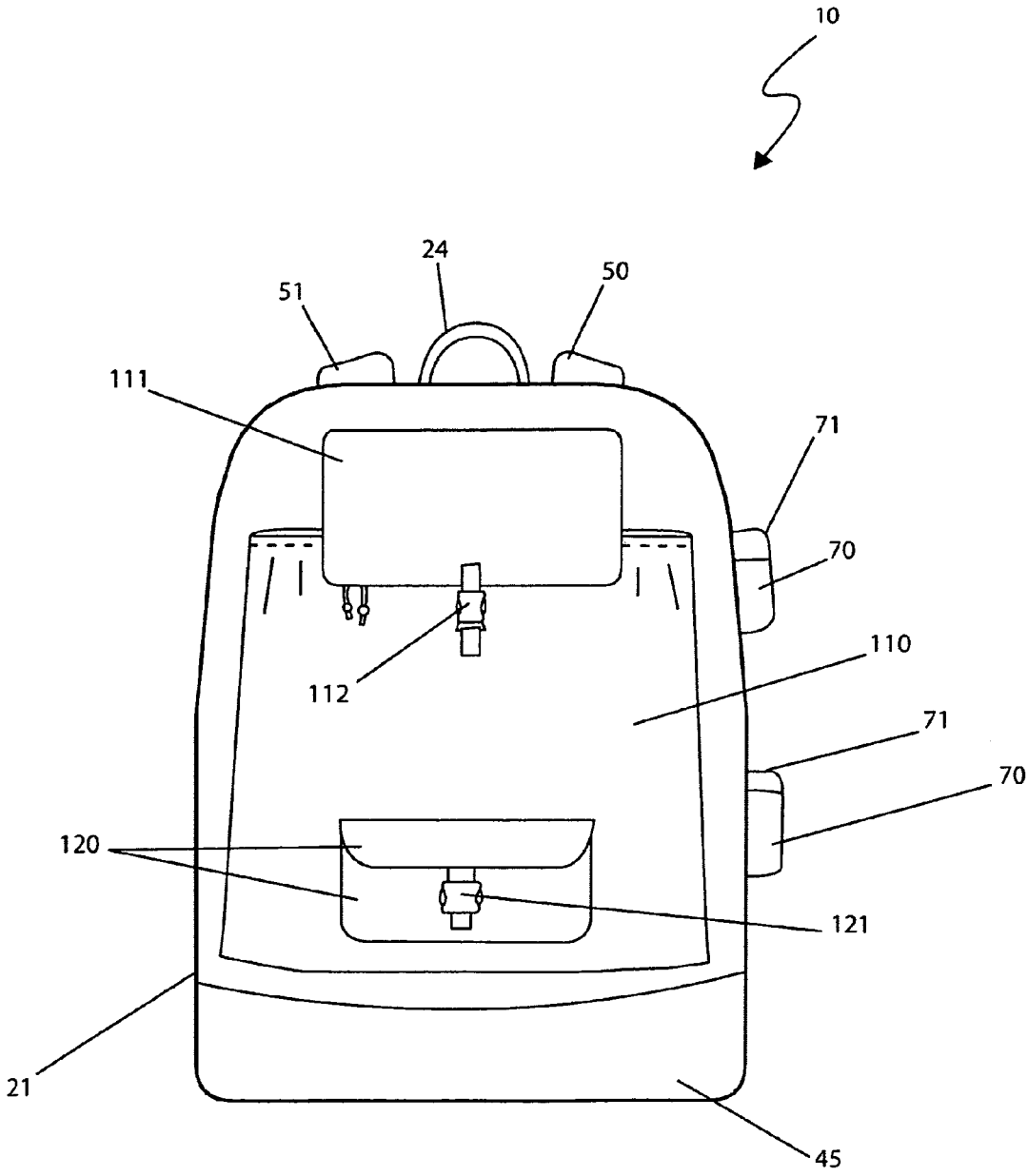
FIG. 3*a* is a rear perspective view of a waterproof backpack with integral garment hangers 10 depicting a closed pouch flap 111, according to a preferred embodiment of the present invention.
Figure 3B:
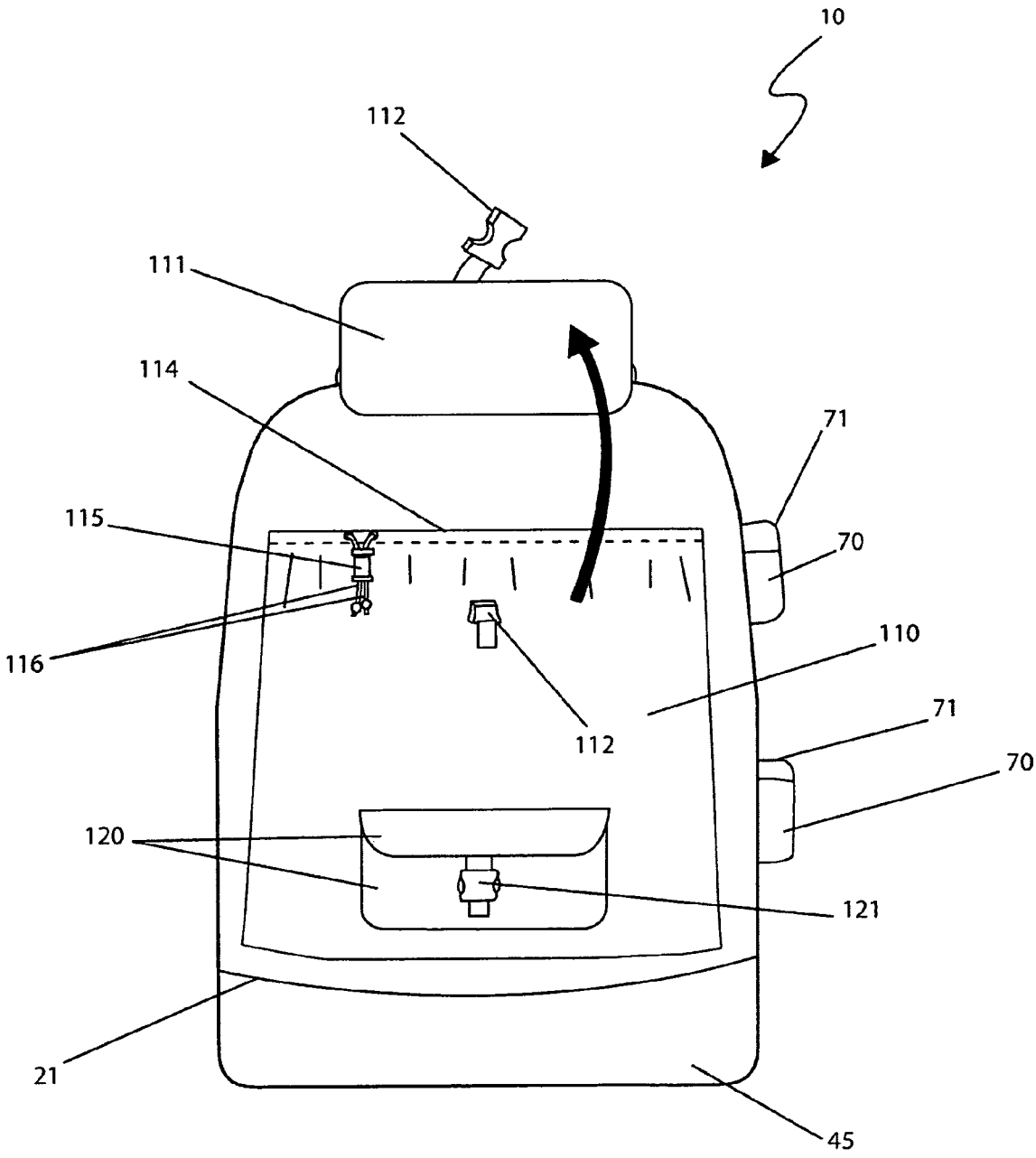
FIG. 3*b* is a rear perspective view of a waterproof backpack with integral garment hangers 10 depicting an open pouch flap 111, according to a preferred embodiment of the present invention.

Referring now to FIGS. 3*a* and 3*b*, rear perspective views of the apparatus 10 depicting a rear pouch portion 110 in closed and open states, according to a preferred embodiment of the present invention, are disclosed. The apparatus 10 comprises a rear pouch 110, a rear pouch flap 111, a third buckle 112, a rear pouch opening 114, a cinch lock mechanism 115, a draw string 116, a rear pocket 120, and a fourth latch 121. The rear pouch 110 provides additional storage capacity thereto a user along a rear surface of the rear compartment assembly 20 being approximately sixteen (16) inches wide and sixteen (16) inches deep and being capable of containing a variety of bulky items. The rear pouch 110 further provides an adjustable top rear pouch opening 114 comprising a common draw string 116 and barrel-shaped spring-loaded cinch lock mechanism 115. The rear pouch flap 111 provides additional protection and security thereto said contents being secured thereto a center area of said rear pouch 110 using a third buckle 112. The rear pocket 120 provides additional storage means along an outer surface of said rear pouch 110 comprising an upper flap and fourth latch 121 in an expected manner. The rear pouch 110 and rear pocket 120 comprise fabric assemblies constructed and affixed thereto using conventional textile industry techniques and are envisioned being made using similar waterproof fabric materials as the aforementioned rear compartment assembly 20. The third 112 and fourth 121 buckles preferably comprises common side release devices or may alternately be provided with slip-lock or equivalent closure mechanisms.

Referring now to FIG. 4, a close-up view of an inner space of the apparatus 10, according to a preferred embodiment of the present invention, is disclosed. The apparatus 10 comprises a second loop 25 which provides an attachment means thereto a hook portion 82 of said folding garment hangers 80 (see FIG. 5*a*). The second loop 25 comprises an elastic textile appendage forming a semi-circle being affixed at both end portions thereto an internal upper central surface of the rear compartment assembly 20 using conventional textile sewing techniques and methods. The elasticity of the second loop 25 allows expansion and insertion of a plurality of folding garment hangers 80 therein. The fourth pocket 60 and fourth pocket flap 61 provide a waterproof, convenient, and secure enclosure along a front surface of the second shoulder strap 51.

Figure 5:
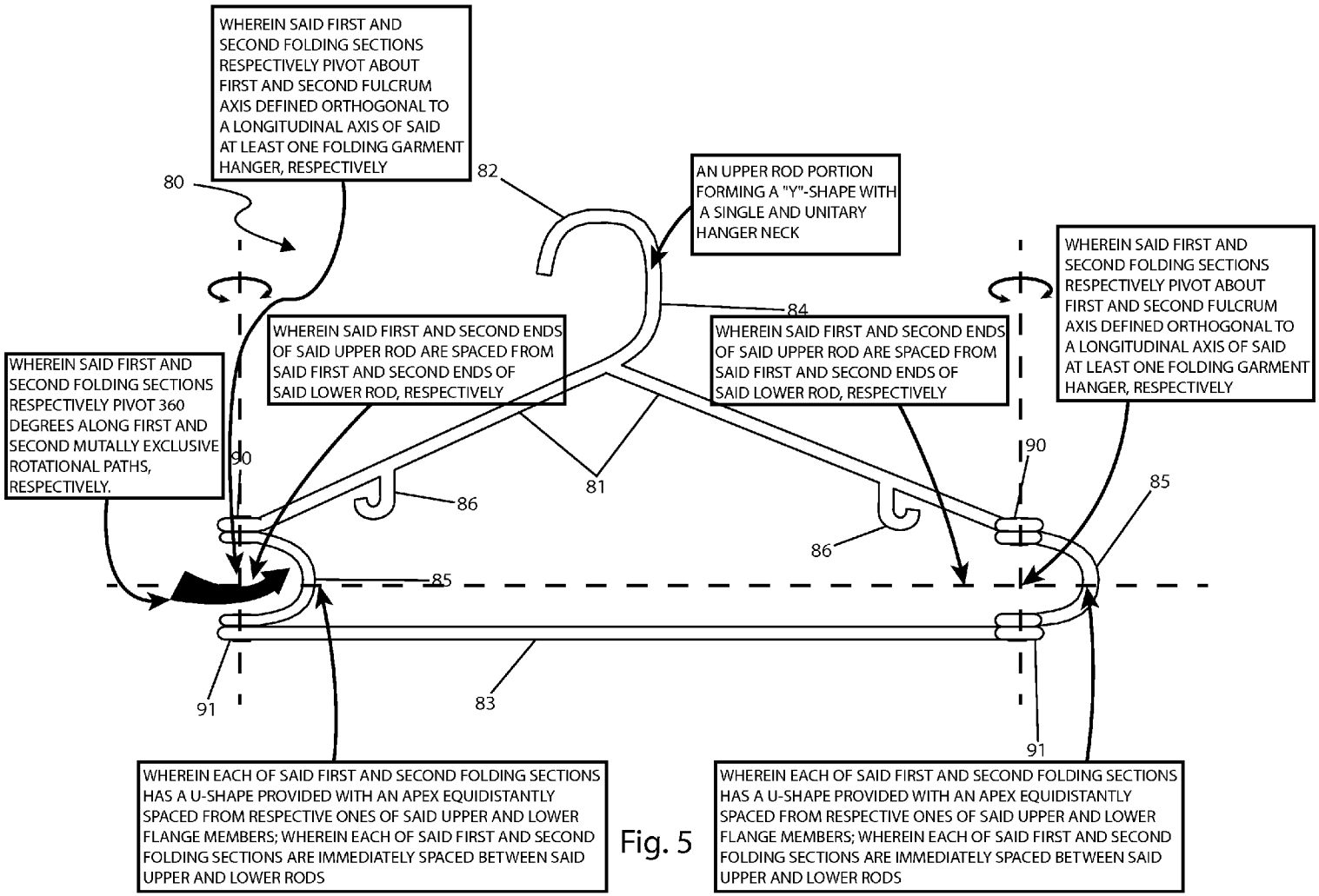

Referring now to FIG. 5, a front view of a folding garment hanger 80, according to a preferred embodiment of the present invention, is disclosed. The folding garment hanger 80 comprises a similar design as a conventional plastic molded hanger comprising plastic molded elements being approximately one-half (½) inch in diameter; however, the folding garment hanger 80 comprises particular features providing compactness so as to fit therein the apparatus 10. The folding garment hanger 80 comprises an upper rod 81, a hanger hook 82, a lower rod 83, a hanger neck 84, a pair of folding sections 85, a pair of garment hooks 86, a pair of upper hinges 90, and a pair of lower hinges 91. The folding garment hanger 80 is envisioned being made of a sturdy plastic material produced in an injection molding process. The upper rod portion 81 comprises a pair of angularly descending elements molded to form an intersection at an upper intermediate position with one another and the hanger neck 84 which extends in an upward direction, thereby forming a molded "Y"-shaped structure. Said upper rod portions 81 also comprise integrally molded garment hooks 86 extending downwardly therefrom in an expected manner providing attachment of strap-type garments. At an upper end portion, the hanger neck 84 transitions to form the hanger hook 82 which takes a form of a semicircle in a conventional manner. Said hanger neck 84 comprises a particularly short vertical length of approximately one (1) inch so as to conserve space therewithin the apparatus 10. The upper rod 81 further provides an attachment means thereto folding hanger sections 85 at opposing lower outer extremities via a pair of upper hinges 90. The folding hanger sections 85 comprises rotating and outwardly projecting "U"-shaped sections providing a width reducing means thereto the folding garment hanger 80 when pivoted inwardly. The folding hanger sections 85 further provide an attachment means thereto a lower rod 83 extending horizontally therebetween said folding hanger sections 85 via a pair of lower hinges 91, thereby forming a closed-loop structure of the folding garment hanger 80. Each hinge 90, 91 is envisioned to comprise a pair of integrally molded flanges and a connecting fastener; however, said hinges 90, 91 may be provided using various pivoting designs and as such should not be interpreted as a limiting factor of the invention 10. It is further envisioned that the folding garment hangers 80 may be removed therefrom the apparatus 10 and used on conventional clothes hanging rod. It is envisioned that a plurality of folding garment hangers 80 may be retained therewithin the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of installing and utilizing the apparatus 10 may be achieved by performing the following steps: exposing the rear compartment 20 by unzipping the first zipper 22 and allowing the forward cover assembly 40 to hinge forward; removing a desired number of folding garment hangers 80 therefrom the second loop 25; hanging one's garments thereupon a desired number of folding garment hangers 80 in a normal fashion; inserting said hangers 80 thereinto the second loop portion 25 of the rear compartment assembly 20; securing said garments thereagainst the rear panel 21 using the restraining straps 27 and integral strap latches 28; loading the internal pockets 26, 29, 43 with garments, clothing, and clothing care items; packing additional folded garment items against the forward cover 40 using the restraining straps 27 and integral strap latches 28 in an expected manner; loading additional bulky items thereinto remaining space therebetween the rear compartment assembly 20 and the forward cover assembly 40 as needed; fastening the forward cover assembly 40 thereto the rear compartment assembly 20 using the two (2) first zipper puller portions 23 of the first zipper 22; placing additional personal items therewithin the fifth pockets 70 and the rear pouch 110 located along outer surfaces of the apparatus 10, as needed; placing one's laptop computer, documents, or other large rectangular objects therewithin the sixth pocket 100 using the third zipper 101; placing one's personal electronic devices such as a cell phone, a blackberry, a PDA, and the like therewithin the fourth pocket 60 located thereupon the second shoulder strap 51; adjusting a length thereof the adjustable straps 52, 53 using the first 54 and second 55 buckles; carrying the apparatus 10 as a backpack thereupon one's back to a destination, as desired; stowing the apparatus 10 upon an airplane as carry-on luggage while traveling; hanging the apparatus 10 thereupon a hook or similar appendage using the first loop 24 upon reaching a destination; unpacking interior and exterior storage pockets and pouches 26, 29, 43, 60, 70, 110 of the apparatus 10 in a normal manner; removing the folding garment hangers 80 and garments hanging thereupon, therefrom the rear compartment assembly 20; utilizing each folding garment hanger 80 in a similar manner as conventional hangers by extending the two (2) folding hanger sections 85; placing one's garments thereupon said desired folding garment hanger 80 in a normal fashion; placing said hangers 80 thereupon a normal closet rod as desired; using various included garment care products to keep clothing and garments fresh and wrinkle free; and, benefiting from neatly hung garments therewithin a compact backpack-like apparatus 10 while traveling.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A waterproof backpack with integral garment hangers, comprising:

a rear compartment assembly comprising a rear panel therein forming a suitcase-like cavity;

a first zipper extending therearound side and perimeter edges of said rear compartment assembly;

a forward cover assembly comprising a front panel and a mating outline therewith said rear compartment assembly and attached thereto said rear compartment assembly by said first zipper;

at least one (1) folding garment hanger for placing a plurality of articles of clothing thereon comprising:

an upper rod portion forming a "Y"-shape with a single and unitary hanger neck;

a semi-circle hanger hook that transitions from said hanger neck;

a first folding section having an upper integral flange member hingedly attached to an upper integral flange member of a first end of said upper rod portion with a first connecting fastener;

a second folding section having an upper integral flange member hingedly attached to an upper integral flange member of a second end of said upper rod portion opposite said first end with a second connecting fastener; and, a lower rod having a lower integral flange member hingedly attached to a lower integral flange member of said first folding section and having a lower integral flange member hingedly attached to a lower integral flange member of said second folding section, each with a third connecting fastener; and, an attachment means for said hanger hook of said folding garment hangers affixed thereto an internal upper central surface of said rear compartment assembly;

wherein said first folding section and said second folding section rotate to provide a width reducing means thereto said folding garment hanger when pivoted inwardly;

wherein said first zipper provides a secure attachment means between said rear compartment assembly and said forward cover assembly;

wherein said backpack allows placement of said plurality of articles of clothing therein said backpack using said folding garment hangers removably attached thereto said attachment means thereby minimizing wrinkling;

wherein each of said first and second folding sections has a U-shape provided with an apex equidistantly spaced from respective ones of said upper and lower flange members;

wherein each of said first and second folding sections are intermediately spaced between said upper and lower rods;

wherein said first and second ends of said upper rod are spaced from said first and second ends of said lower rod, respectively;

wherein said first and second folding sections respectively pivot about first and second fulcrum axes defined orthogonal to a longitudinal axis of said at least one folding garment hanger, respectively; and, wherein said first and second folding sections respectively pivot 360 degrees along first and second mutually exclusive rotational paths, respectively.

2. The backpack of claim 1, wherein said attachment means is an elastic second loop affixed thereto an internal upper central surface of said rear compartment assembly.

3. The backpack of claim 1, wherein said first zipper further comprises at least one (1) first zipper puller, thereby allowing a user to open said rear compartment assembly by moving said at least one (1) first zipper puller thereto opposing lower portions of said rear compartment assembly.

4. The backpack of claim 1, wherein said folding garment hanger further comprises a first garment hook and a second garment hook integrally molded thereto said upper rod portion and extending downwardly.

5. The backpack of claim 1, wherein said rear compartment assembly further comprises a first loop connected at a top external surface of said rear compartment assembly providing a hanging means to said backpack.

6. The backpack of claim 1, wherein said rear compartment assembly further comprises at least one (1) first pocket located along an interior surface of said rear panel.

7. The backpack of claim 1, wherein said rear compartment assembly further comprises at least one (1) rear compartment restraining strap laterally extending across said rear panel, thereby providing a securing means thereto said plurality of articles of clothing comprising a sewn-in strap latch for adjusting said rear compartment restraining strap.

8. The backpack of claim 1, wherein said rear compartment assembly further comprises a mesh second pocket located along an inner surface of said rear panel comprising a second zipper operated by a second zipper puller.

9. The backpack of claim 1, wherein said forward cover assembly further comprises:

a first shoulder strap and a second shoulder strap attached thereto an upper edge region of said forward cover assembly extending in a downward direction;

a first adjustable strap attached to said first shoulder strap comprising a first buckle adjustably attached to a first lower strap sewn thereto a lower portion of said forward cover assembly; and, a second adjustable strap attached to said second shoulder strap comprising a second buckle adjustably attached to a second lower strap sewn thereto said lower portion of said forward cover assembly;

wherein said first buckle and said second buckle provide a length adjustment means thereto said first adjustable strap and said second adjustable strap, respectively.

10. The backpack of claim 9, wherein said first shoulder strap or said second shoulder strap further comprises a fourth pocket and a fourth pocket flap for closing said fourth pocket.

11. The backpack of claim 1, wherein said rear compartment assembly further comprises at least one (1) external fifth pocket located along an outer side surface of said rear compartment assembly and comprising a fifth pocket flap providing a closing means to said fifth pocket.

12. The backpack of claim 1, wherein said forward cover assembly further comprises a mesh third pocket comprising a third pocket opening located along an inner surface of said front panel.

13. The backpack of claim 1, wherein said forward cover assembly further comprises at least one (1) forward cover restraining strap laterally extending across said front panel, thereby providing a securing means thereto said plurality of articles of clothing comprising a sewn-in strap latch for adjusting said forward cover restraining strap.

14. The backpack of claim 1, wherein said backpack further comprises a reinforced area comprising a resilient sewn-in panel covering bottom and lower sides of said backpack.

15. The backpack of claim 1, wherein said backpack further comprises a sixth pocket located along a side surface of said rear compartment assembly and comprising a third zipper extending vertically along said side surface.

16. The backpack of claim 1, wherein said backpack further comprises a waist strap located thereon a lower side portion of said front panel and comprising side-release latching components.

17. The backpack of claim 1, wherein said backpack further comprises:

a rear pouch portion located along a rear surface of said rear compartment assembly comprising a rear pouch opening adjustable by a draw string and a cinch lock mechanism;

a rear pouch flap for protecting said rear pouch portion removably attached to a third buckle located on an outer surface of said rear pouch portion; and, a rear pocket located along said outer surface of said rear pouch portion comprising an upper flap and a fourth latch for closing said rear pocket.

18. The backpack of claim 1, wherein said plurality of pockets comprises a varying degree of sizes.

19. The backpack of claim 1, wherein said backpack is made of a Gore-Tex material.

20. A method for using a waterproof backpack with integral garment hangers, said method comprising the steps of:

providing said backpack, comprising:

a rear compartment assembly comprising a rear panel therein forming a suitcase-like cavity;

a first zipper extending therearound side and perimeter edges of said rear compartment assembly;

a forward cover assembly comprising a front panel and a mating outline therewith said rear compartment assembly and attached thereto said rear compartment assembly by said first zipper;

at least one (1) folding garment hanger for placing a plurality of articles of clothing thereon comprising:

an upper rod portion forming a "Y"-shape with a hanger neck;

a semi-circle hanger hook that transitions from said hanger neck;

a first folding section attached to a first end of said upper rod portion by a first upper hinge;

a second folding section attached to a second end of said upper rod portion opposite said first end by a second upper hinge; and, a lower rod attached to said first folding section by a first lower hinge and attached to said second folding section by a second lower hinge;

wherein each of said first folding and second folding sections has a U-shape provided with an apex equidistantly spaced from respective ones of said upper and lower hinges;

wherein said first and second folding sections respectively pivot about first and second fulcrum axes defined orthogonal to a longitudinal axis of said at least one folding garment hanger, respectively;

wherein said first and second folding sections respectively pivot 360 degrees along first and second mutually exclusive rotational paths, respectively; and an attachment means for said hanger hook of said folding garment hangers affixed thereto an internal upper central surface of said rear compartment assembly;

wherein said first folding section and said second folding section rotate to provide a width reducing means thereto said folding garment hanger when pivoted inwardly;

wherein said first zipper provides a secure attachment means between said rear compartment assembly and said forward cover assembly; and, wherein said backpack allows placement of said plurality of articles of clothing therein said backpack using said folding garment hangers removably attached thereto said attachment means thereby minimizing wrinkling;

exposing said rear compartment assembly by unzipping said first zipper and allowing said forward cover assembly to hinge forward;

removing a desired number of said folding garment hangers therefrom a second loop;

hanging said plurality of articles of clothing thereupon a desired number of said folding garment hangers;

inserting said garment hangers thereinto said second loop of said rear compartment assembly;

securing said plurality of articles of clothing thereagainst said rear panel using at least one (1) rear compartment restraining strap and at least one (1) forward cover restraining strap;

loading an internal first pocket, an internal second pocket, and an internal third pocket with additional items;

packing additional folded garment items against said forward cover assembly using said at least one (1) forward cover restraining strap;

loading additional bulky items thereinto remaining space therebetween said rear compartment assembly and said forward cover assembly as needed;

fastening said forward cover assembly thereto said rear compartment assembly using at least one (1) first zipper puller of said first zipper;

placing additional personal items therewithin a fifth pocket and a rear pouch located along an outer surface of said backpack, as needed;

placing large objects therewithin a sixth pocket using a third zipper;

placing smaller objects therewithin a fourth pocket located thereupon either a first should strap or a second shoulder strap;

adjusting a length thereof a first adjustable strap and a second adjustable strap using a first buckle and a second buckle;

carrying said backpack thereupon one's back to a destination, as desired;

stowing said backpack upon an airplane as carry-on luggage while traveling;

hanging said backpack thereupon a support structure using a first loop upon reaching a destination;

unpacking interior and exterior storage pockets and pouches of said backpack;

removing said folding garment hanger and said plurality of articles of clothing hanging thereupon, therefrom said rear compartment assembly;

utilizing each of said folding garment hanger in a similar manner as conventional hangers by extending said first folding section and said second folding section;

placing one's garments thereupon said desired folding garment hanger;

placing said folding garment hanger thereupon a closet rod as desired; and, benefiting from neatly hung said plurality of articles of clothing therewithin said backpack while traveling.

* * * * *